United States Patent [19]

Delaval et al.

[11] 4,169,905

[45] Oct. 2, 1979

[54] PROCESS FOR LUBRICATING TEXTILE THREADS

[75] Inventors: Jean-Claude Delaval, Lyons; Joseph Stagnetto, Oullins, both of France

[73] Assignee: Rhone-Poulenc Industries, Paris, France

[21] Appl. No.: 849,212

[22] Filed: Nov. 7, 1977

[30] Foreign Application Priority Data

Nov. 30, 1976 [FR] France ..... 76 36005

[51] Int. Cl.[2] ..... D01D 11/06; D01F 11/04; D01G 29/00

[52] U.S. Cl. ..... 427/177; 427/240; 427/299; 427/322; 427/387; 428/391

[58] Field of Search ..... 428/375, 391; 118/425, 118/421, 50; 28/284; 427/387, 394, 390 R, 390 B, 443, 371, 358, 177, 240, 299, 322, 430; 68/198; 8/155.1

[56] References Cited

U.S. PATENT DOCUMENTS

| | | | |
|---|---|---|---|
| 1,770,729 | 7/1930 | Borzykowski | 427/240 |
| 2,138,216 | 11/1938 | Sunderland | 8/155.1 |
| 3,423,235 | 1/1969 | Campbell | 428/391 |
| 3,493,425 | 3/1970 | Campbell | 428/391 |
| 3,779,048 | 12/1973 | Kitamura et al. | 68/150 |
| 3,844,826 | 10/1974 | Buchner et al. | 428/391 |
| 3,871,909 | 3/1975 | Aldrich | 427/322 |
| 3,960,487 | 6/1976 | Stritzko | 68/198 X |
| 3,965,283 | 6/1976 | Moore | 427/322 X |

FOREIGN PATENT DOCUMENTS

| | | | |
|---|---|---|---|
| 1173705 | 12/1969 | United Kingdom | 260/448.2 B |
| 1295035 | 11/1972 | United Kingdom | 427/387 |

*Primary Examiner*—Ronald H. Smith
*Assistant Examiner*—Raymond C. Johnson
*Attorney, Agent, or Firm*—Burns, Doane, Swecker & Mathis

[57] ABSTRACT

A process for lubricating textile threads by treatment in an aqueous bath containing a lubricating agent is disclosed which comprises the steps of:

(a) impregnating bobbins of the textile thread with an aqueous bath liquid containing dispersed therein an amount of from about 6 to about 20%, by weight, of at least one organosilicon polymer lubricating agent;

(b) removing the impregnated bobbins of thread from the bath liquid;

(c) removing from the impregnated bobbins such an amount of adhering bath liquid that the resulting moist bobbins of thread retain only an amount of from about 25 to about 70%, by weight, of the bath liquid relative to the weight of the dry thead; and, (d) drying the moist bobbins of thread sufficiently to substantially remove their absorbed water content.

The process may be effected at ambient temperature in a dyeing apparatus directly subsequent to a dyeing procedure. It provides a homogeneous coating of organosilicon polymer lubricating agent and is especially suited for lubricating sewing threads for use on high speed sewing machines.

21 Claims, No Drawings

PROCESS FOR LUBRICATING TEXTILE THREADS

BACKGROUND OF THE INVENTION

1. Field of the Invention

The present invention relates to an improved process for lubricating textile yarns, especially sewing threads, by means of organosilicon polymers which comprise impregnating the threads in an aqueous bath.

2. Description of the Prior Art

It is known to treat sewing threads with organosilicon polymers with the purpose of eliminating or reducing the abrading which is encountered on high speed sewing machines. Various different methods are used to effect this treatment. Among these are the following: applying an oily substance by means of a roller, pulverization (whereby organosilicon polymers which are projected onto the thread are used in pure or in diluted form) immersion into a bath which contains water and/or organic solvents as a diluent.

For the manufacturers or users of textile threads who possess a dyeing apparatus, it is very practical to carry out this treatment by circulating an aqueous bath liquid in this dyeing apparatus.

The working method which is used is analogous to that which is used in a dyeing procedure:

An aqueous dispersion of the organosilicon polymers which is brought to an appropriate temperature, usually in the range of from about 60° to 80° C., and is adjusted to an appropriate pH value, usually in the range of from about 6 to 7.5, is injected into the dyeing apparatus wherein the threads are kept in the form of bobbins which are still soaked in the rinsing water. The dispersions are alternatingly injected either in the direction from the internal zone within the bobbins to the zone outside the bobbins or in the opposite direction. This circulation of the liquid of the dispersion is continued for such a period of time as is needed for depositing the organosilicon polymers on the thread. Subsequently, the bobbins are dried.

Such a treatment is designated as being substantive and is characterized by exhaustive extraction of the major portion of the organosilicon polymer which is introduced in the aqueous dispersion. This technique has evident advantages as compared with the older techniques, such as applying an oil by means of a roller. In the latter case, it is necessary at the end of the dyeing phase, to dry the thread on the bobbins, unspool it and re-spool it after applying the oil.

In the substantive treatment, these necessities are eliminated. However, further improvements of this method are still needed in the art, since carrying out this working procedure requires a very strict adjustment of the pH value and the heating of the dispersions. Furthermore, hardly more than 80 to 90% of the amount of organosilicon polymers which are present in the dispersions are used up. Finally, the polymers are not always deposited homogenously throughout the mass of bobbins.

Instead of effecting the lubrication of the thread by a substantive treatment in a dyeing apparatus after the dyeing operation, it is possible to effect this treatment at the same time as the dyeing by incorporating the organosilicon polymers into the dye bath which contains the dyestuff, as has been disclosed in the French published Patent application No. 2,076,039. However, this process cannot generally be used for all types of dyes, since due to their strongly hydrophobic properties, the organosilicon polymers not only disturb the stability of the dye baths, but also the fixing of the dye on the thread.

SUMMARY OF THE INVENTION

It is an object of the present invention to provide a new and improved process for lubricating textile yarns, especially sewing threads, which avoids the above-mentioned disadvantages of the prior art processes.

It is a further object of the present invention to provide such a lubricating process which provides for an equally and homogenously distributed film of the lubricant on the surface of the thread, in particular a process by which a uniform gliding of the thread on the tension wheel of a sewing machine is ensured and the formation of friction heat is reduced and an excessive heating of the sewing needle when sewing thick tissues is avoided and the number of ruptures of the thread during sewing on a high speed sewing machine is reduced.

It is a further object of the present invention to provide such a process which can be effected at ambient temperature in a relatively short period of time.

It is still a further object of the present invention which permits to more fully utilize the amount of lubricating agent in the lubricating liquor.

In order to accomplish the foregoing objects, according to the present invention, there is provided a process for lubricating textile threads, in particular, sewing threads, which comprises the steps of:

(a) impregnating bobbins of the textile thread with an aqueous bath liquid containing dispersed therein an amount of from about 6 to about 20%, by weight, of at least one organosilicon polymer lubricating agent;
(b) removing the impregnated bobbins of thread from the bath liquid;
(c) removing from the impregnated bobbins such an amount of adhering bath liquid that the resulting moist bobbins of thread retain only an amount of from about 25 to about 70%, by weight, of the bath liquid relative to the weight of the dry thread; and,
(d) drying the moist bobbins of thread sufficiently to substantially remove their absorbed water content.

The bobbins of textile thread are moistened with an aqueous liquid prior to the impregnating step.

The process may be effected at ambient temperature, and can be carried out in a dyeing apparatus subsequent to a dyeing procedure.

According to the present invention, there is further provided a homogenously lubricated thread comprising a coating of an organosilicon polymer lubricating agent, in particular, a thread, which is especially suited for sewing on high speed sewing machines.

Further objects, features, and advantages of the present invention will become apparent from the detailed description of the invention and its preferred embodiments which follow.

DETAILED DESCRIPTION OF THE INVENTION

The process according to the present invention constitutes an improvement over the prior art processes of lubricating sewing threads. According to the present process, the bobbins of thread can be treated with the dispersion of the lubricating organosilicon polymer agent in a dyeing apparatus directly after the dyeing phase.

Within the process according to the present invention, any organosilicon polymers, which are conventionally used for lubricating natural or synthetic fibers, can be used as lubricating agents within the aqueous bath liquid.

For example, any lubricating organosilicon polymer oils or oily mixtures of organosilicon polymers, can be used. The viscosity of these lubricants may vary in the range of from about 50 cp to about 10 million cp at 25° C. The term "organosilicon", as used in the present specification and claims, is meant to connote polymers wherein all the recurring units are organosilicon units, as well as block copolymers, wherein part of the blocks are formed from organosilicon units.

Preferred organosilicon polymers comprise straight polydiorganosiloxanes, especially polydialkylsiloxanes, the chains of which are terminated by hydroxy, lower alkoxy containing 1 to 4 carbon atoms, or triorganosiloxyl-, especially trialkylsiloxyl groups, wherein any alkyl groups preferably are lower alkyl groups. The polydiorganosiloxanes may be homo- or copolymers. The degree of polymerization may vary in such a range as to provide for a viscosity of the polymers of from about 50 cp to about 10 million cp, at 25° C.

These polyorganosilicon polymers preferably comprise a substantial portion of recurring units of the formula $R_2SiO$. Yet, the presence of up to 2% of the units of organosiloxyl units of the formula $R\ SiO_{1.5}$ and/or of siloxyl units of the formula $SiO_2$ is not excluded. The organic groups R, which are attached to the silicium atoms of the polymers, are usually hydrocarbon groups containing 1 to 18 carbon atoms, which may be substituted by halogen, amino and cyano.

As examples of hydrocarbon groups which may be attached to the silicium atoms, the following are cited:

alkyl containing 1 to about 18 carbon atoms, such as methyl-, ethyl-, propyl-, butyl-, hexyl-, 2-ethylhexyl-, octyl-, decyl-, dodecyl-, tetradecyl-, pentadecyl-, and octadecyl groups;

alkenyl containing 2 to about 4 carbon atoms, such as vinyl-, allyl-, and butene-2-yl;

cycloalkyl containing 5 to about 8 carbon atoms, such as cyclopentyl-, cyclohexyl-, methylcyclohexyl- and dimethyl cyclohexyl;

monocyclic aryl containing 6 to about 10 carbon atoms, such as phenyl, tolyl, xylyl, phenethyl, and 2-phenylpropyl.

As examples of substituted hydrocarbon groups, the following may be cited:

3,3,3-trifluoropropyl, chlorocyclohexyl, chlorophenyl, 3-aminopropyl 3-[N-(2-aminoethyl)amino]propyl, and 3-cyanopropyl.

As examples of lower alkoxy, which terminates the polydiorganosiloxane chains, the following may be cited:

methoxy, ethoxy, propoxy, isopropoxy, n-butoxy, and tertiary butoxy.

Most of the polydiorganosiloxanes are commercially available from silicon manufacturers. Furthermore, they may be prepared according to known methods which are described in the chemical literature.

For example, information concerning their preparation can be found in the following prior art references:

Preparation of polydiorganosiloxanes each end of the chains of which is terminated by a hydroxyl group in the French Pat. Nos. 1,134,005, 1,198,749, 1,226,745, 1,276,619, and 1,278,281.

Preparation of polydiorganosiloxanes wherein one end of the chain is terminated by alkoxy and the other is terminated by alkoxy or hydroxy in the French Pat. Nos. 938,292, 1,116,196, and 1,575,758.

Polydiorganosiloxanes wherein one end of the chain is terminated by a triorganosiloxyl group and the other is terminated by hydroxyl or triorganosiloxyl in the French Pat. Nos. 979,058, 1,025,150, 1,108,764, 1,370,884, 1,499,845, 1,570,102, and 1,570,178.

Amongst the above polydiorganosiloxanes, easily available polymers are those wherein the organic group R is selected from the group consisting of methyl, ethyl, propyl, vinyl, and phenyl and wherein at least 40% of the organic groups are methyl.

As examples of this type of polydiorganosiloxane, the following may be cited:

polydimethylsiloxanes wherein both ends of the chains are terminated by trimethylsiloxyl, hydroxy or methoxy;

polymethylphenylsiloxanes wherein both ends of the chains are terminated by trimethylsiloxyl, phenyldimethylsiloxyl, hydroxy, methoxy, or ethoxy.

The polymethylphenylsiloxanes are formed by recurring units selected from the group consisting of units of the formulae $(CH_3)_2SiO$, $(CH_3)(C_2H_6)SiO$, and $(C_6H_5)_2SiO$, and comprise at least one of the two latter units.

As examples of polydiorganosiloxanes which are not quite as easily available as are the ones which have just been mentioned, such polydiorganosiloxanes may be cited wherein the entire length of the chain is formed by a combination of recurring units which are selected from units of the formulae $CH_3(C_{10}H_{21})SiO$, $CH_3(C_{14}H_{29})SiO$, $CH_3(C_6H_5CH_2\text{-}CH_2)SiO$ and $$CH_3(C_6H_5\underset{\underset{CH_3}{|}}{CH}-CH_2)SiO,$$

and wherein each of the chain ends is preferably terminated by a unit of the formula $(CH_3)_3SiO_{0.5}$. Of course, according to the process of the present invention, mixtures of the above polydiorganosiloxanes having different viscosities can also be used. Thus, as has been mentioned in the U.S. Pat. No. 3,869,032, suitable mixtures may comprise from about 10 to about 75% of a polydimethylsiloxane having a viscosity of from about 20 to about 200 cp at 25° C., from about 10 to about 50% of a polydimethylsiloxane having a viscosity of from about 1,000 to about 30,000 cp at 25° C., and from about 20 to about 80% of a polydimethylsiloxane having a viscosity of from about 201 to about 999 cp at 25° C.

Further to the above described polydiorganosiloxanes, block copolymers comprising a major portion of polydiorganosiloxane blocks can also be used. In addition to the polydiorganosiloxane blocks, which preferably are polydimethylsiloxane blocks, the block copolymers may contain polyether blocks, e.g., polyoxyalkylene blocks, such as polyoxyethylene- and/or polyoxypropylene blocks, or polycarbonate blocks. The polyether blocks may contain between 2 and about 150 recurring lower oxyalkylene units. The polycarbonate blocks preferably are based on dihydroxydiphenyl lower alkanes, e.g., 2,2-bis(4'-hydroxyphenyl)propane, and preferably contain 2 to 5 recurring carbonate units.

Suitable block copolymers include, for example, block copolymers containing from about 65 to about 92%, by weight, of polydimethylsiloxane blocks and from about 8 to about 35%, by weight, of polycarbonate blocks. Preferably these polycarbonate blocks comprise 2 to 4 chain units of the formula $+C_6H_4—C(CH_3)_2—C_6H_4—OCOO+$ and the polydimethylsiloxane blocks comprise an average of from about 15 to about 90 dimethylsiloxyl units. The preparation of these block copolymers is described in the U.S. Pat. No. 3,844,826.

French Pat. Nos. 1,175,305, 1,327,546, 1,330,956, and 1,486,749, and the preparation of the copolymers of formula $F_2$ are disclosed, for example, in the French Pat. Nos. 1,125,436, 1,135,290, and 1,323,121.

Most of these copolymers are commercially available. The following formulae indicate specific examples of suitable copolymers:

$$CH_3Si\left[(OSi(CH_3)_2)_{3.1}(OCH(CH_3)—CH_2)_{12.5}OC_4H_9\right]_3$$

$$CH_3Si\left[(OSi(CH_3)_2)_{18}(OCH(CH_3)—CH_2)_{14}(OCH_2CH_2)_{18}OC_4H_9\right]_3$$

$$C_2H_5Si\left[(OSi(CH_3)_2)_8(OCH(CH_3)—CH_2)_{11}(OCH_2CH_2)_4OC_2H_5\right]_3$$

$$(CH_3)_3Si(OSi(CH_3)_2)_{75}(OSi(CH_3)(CH_2)_3(OCH_2CH_2)_{22}(OCH(CH_3)—CH_2)_{23.5} \longrightarrow OCOCH_3)_7OSi(CH_3)_3$$

$$(CH_3)_3Si(OSi(CH_3)_2)_7(OSi(CH_3)(CH_2)_3(OCH_2CH_2)_8(OCH(CH_3)—CH_2)_2OH)_3 \longrightarrow OSi(CH_3)_3$$

$$CH_2{=}CH(CH_3)_2Si(OSi(CH_3)_2)_{21}(OSi(CH_3)(CH_2)_2(OCH(CH_3)—CH_2)_{15}OH)_4 \longrightarrow OSi(CH_3)_2CH{=}CH_2$$

$$C_2H_5(CH_3)_2Si(OSi(CH_3)_2)_{30}(OSi(CH_3)(CH_2)_3(OCH_2CH_2)_{11}(OCH(CH_3)—CH_2)_{14} \longrightarrow OCOCH_3)_{4.3}OSi(CH_3)_2C_2H_5$$

$$(CH_3)_3Si(OSi(CH_3)_2)_{135}(OSi(CH_3)(CH_2)_3(OCH_2CH_2)_{25}(OCH(CH_3)—CH_2)_{26} \longrightarrow OCOCH_3)_{16}OSi(CH_3)_3$$

Suitable block copolymers of the type of polydiorganosiloxane-polyether copolymers are polydimethylsiloxane-polyether block copolymers corresponding to the formulae $F_1$ and $F_2$ below:

$$R''Si\left[(OSi(CH_3)_2)_a(OCH(CH_3)CH_2)_b(OCH_2CH_2)_cOR'''\right]_3 \qquad (F_1)$$

$$R'(CH_3)_2Si(OSi(CH_3)_2)_d(OSi(CH_3)G(OCH(CH_3)—CH_2)_b(OCH_2CH_2)_cOR''')_dOSi(CH_3)_2R' \qquad (F_2)$$

wherein R' represents methyl, ethyl, vinyl or phenyl, R'' represents methyl or ethyl, R''' represents hydrogen, methyl, ethyl, propyl, butyl or acetyl, G represents alkylene containing 1 to 4 carbon atoms, a represents a number of from about 5 to about 180, b represents a number of from about 3 to about 50, c represents a number of from zero to about 40, whereby in the case that c does not represent zero, the sum of b+c is a number of from about 8 to about 70 and the ratio b/c is at least 0.2, and d represents a number of from 1 to about 50.

These copolymers are liquid at ambient temperature and their viscosity at 25° C. usually is in the range of from about 200 cp to about 100,000 cp. Their preparation is well known in the art. For example, the preparation of copolymers of the formula $F_1$ is disclosed in the The use of only organosilicon polymers leads to good results in lubricating textile threads, yet the addition of other than organosilicon materials is sometimes advisable to increase this lubrication. For this purpose, other synthetic or naturally-occurring polymeric organic products, which exhibit lubrication favoring properties may be added in amounts of not more than 40%, by weight, of the amount of organosilicon polymers. As products of this type, the following may be cited: polyethylenes, propylene polymer waxes, butylene polymer waxes, beeswax, and paraffins.

When organosilicon polymers are used which are not readily soluble and/or dispersable in water, these polymers are often introduced into the aqueous bath liquid in the form of an aqueous emulsion, which may be prepared in the presence of an emulsifying agent. Usually the organosilicon polymers are not water soluble, except for those which include an appropriate amount of amino- or polyaminoalkyl groups and for those of the type of polydimethylsiloxanepolyether block copolymers with strongly hydrophilic properties.

In order to prepare the aqueous organosilicon polymer emulsions, conventional methods are applied. For example, the organosilicon polymer emulsifying agents and water are introduced into a colloidal grinder/mixer and mixed therein. At the outlet of the grinder, more or less viscid emulsions are recovered which may be diluted by adding water. Yet, it is necessary that the resulting aqueous emulsions comprise a sufficiently high amount of the organosilicon polymers, since the aqueous bath liquids which are prepared from these emulsions must contain from about 6 to about 20%, by weight, of the organosilicon polymer, which represents a relatively high concentration. It is also advisable to prepare emulsions which contain at least 20%, preferably at least 30%, of the organosilicon polymer. The upper limit of the polymer content in the emulsion may vary depending on the type of polymer and the type of emulsifying agents which are used. Yet, usually it does not exceed 70%.

As emulsifying agents for preparing the emulsions, preferably cationic surface active agents are used which usually include salts of aliphatic amines, quaternary ammonium salts and pyridinium salts or also salts of amidoamines and esteramines. Preferably the nitrogen atom in these salts is substituted by at least one hydrocarbon group containing at least about 8 carbon atoms, e.g., between about 8 and about 25 carbon atoms.

Further to cationic substances, nonionic surface active agents may also be used to a lesser degree. Suitable examples of nonionic surface active agents are alkylphenyl- or alkyl monoethers of polyalkylene glycols, amides of polyethoxylated fatty acids and various types of polyvinyl alcohols.

It is recommended to use the emulsifying agents in amounts of about 2 to about 15%, by weight, relative to the total amount of lubricating agents which are used. Further to the emulsifying agents, various additives, such as anti-static agents, stabilizers and anti-gelling or anti-freezing agents.

Then, preferably at the time of use for a lubricating treatment of a textile thread, the aqueous emulsions are diluted by adding an appropriate amount of water in order to obtain an aqueous bath liquid containing the desired concentration of organosilicon polymers. As has been indicated above, this concentration should be from about 6 to about 20%, preferably from about 7 to about 18%, by weight, of the bath liquid.

These aqueous bath liquids may also be prepared by introducing an appropriate amount of the emulsion into water which has previously been introduced into a dyeing apparatus. These apparatus comprise appropriate support means onto which the bobbins of thread which are to be treated are placed. They further comprise a piping system and pumps for circulating the bath liquid alternatingly from the zone within the bobbins towards the zone outside the bobbins and in opposite directions, that is from the zone outside the bobbins towards the zone inside the bobbins.

Once the aqueous bath liquid is present in the dyeing apparatus, the impregnating treatment is rapidly effected. This treatment is carried out at ambient temperature, that is at a temperature of usually between about 15° and about 30° C., and usually takes place in a period of time of about 10 minutes, during which period the bath liquid circulates through the bobbins.

After this impregnation period, the bobbins are removed from the bath, and part of the adhering bath liquid is removed therefrom, preferably without applying any heat at, e.g., ambient temperature.

For example, the bobbins are removed from the dyeing apparatus and placed into a centrifugal dryer where the bath liquid is removed by centrifuging or spin drying. According to another method which may be used, if the axes which support the bobbins are firmly connected with a device which is turning at high speed, the bath is evacuated and the adherent bath liquid is removed from the bobbins on the spot. The adhering bath liquid may also be removed by draining it off, e.g., in a vacuum dryer.

In any case, the removal of the adhering bath liquid is carried out in such a way that the moist bobbins retain from about 25 to about 70%, preferably from about 28 to about 67%, by weight, relative to the weight of the thread in the dried non-treated state, of the aqueous bath liquid. Subsequently, the bobbins are dried in a conventional manner, e.g., with hot air, for example, by leaving same in a ventilated oven which is heated to a temperature of from about 50° to about 100° C., or more, conveniently by blowing hot air which has been heated to a temperature of from about 80° to about 130° C. thereon.

As a result, the thread is impregnated with an amount of from about 1.5 to about 14%, preferably from about 1.9 to about 12%, by weight, of the organosilicon polymer (relative to the weight of the thread in the dry non-treated state). This amount of organosilicon polymer may vary depending on the concentration of organosilicon polymers which have been introduced into the bath liquid and on the amount of bath liquid which is retained on the bobbins after the removal of a part of the adhering bath liquid therefrom.

The coating of organosilicon polymer on the thread, which is obtained by this procedure, is perfectly homogenous, it provides the thread with an excellent lubrication when it is used on high speed sewing machines. In particular, this homogeneity of the coating favorizes a uniform gliding of the thread on the tension wheel and furthermore, it prevents the excessive heating of the needles of the machine when these pass through very thick layers of material. Furthermore, the number of ruptures which occur by melting of the thread at times of frequently repeated starts of the machine is limited.

Threads which are made of a wide variety of synthetic fibers (eventually in admixture with naturally-occurring fibers, such as wool, cotton and silk) can be treated according to the process of the present invention. The following are cited as examples: polyamide fibers, polyester fibers, polyethylene fibers, polyacrylnitrile fibers and polyurethane fibers.

The following examples further illustrate the present invention, (parts and percentages are expressed as by weight).

EXAMPLE 1

Lubrication of a Polyester thread

An apparatus for dyeing threads by the exhaustive extraction method was used. This apparatus comprised:

(1) a chamber of 300 liter content which was provided with a piping system and a pump, and (2) an assemblage carrying the bobbins which was situated inside the chamber.

This assemblage itself comprised:

a horizontal plate having a surface of 4,000 $cm^2$;

a vertical axis which was placed in the center of the plate;

four vertical axes with perforated walls which were firmly connected with the plate and were placed concentrically around the central axis at equal distance from each other.

Onto each of the perforated axes, four bobbins of a thread of staple ethylene polyterephthalate fibers were mounted. The thread which consisted of three twisted strands, comprised a length of 100 meters per gram. The bobbins which each contained 850 g of dry thread were impregnated with water (in an amount of 120%, by weight, of the weight of the dry thread), which originated from a rinsing operation after dyeing the threads azur blue.

Independently, an aqueous emulsion "Q" was prepared by introducing into a colloidal grinder/mixer a mixture containing:

5.5 parts of an $\alpha,\omega$-bis(trimethylsiloxy)dimethyl polysiloxane oil having a viscosity of 5,000 cp at 25° C.;

2.5 parts of dioleate of triethylene diamine, the nitrogen atom of which was substituted by an aliphatic group derived from fatty acids of tallow fat;

2.5 parts of a monoamine the nitrogen atom of which was substituted by an aliphatic group derived from fatty acids of coconut fat.

This mixture was ground and then diluted by introducing 40 parts of water. The resulting emulsion "Q" thus comprised 55% of organosilicon polymers.

200 l of an aqueous bath liquid which were obtained by diluting 20 parts of the emulsion "Q" with 80 parts of demineralized water were placed into the chamber of the apparatus. The apparatus bath liquid thus contained 11% of organosilicon polymers.

By means of the pump, the water of the bath liquid was put into circulation for three minutes in the direction from the perforated axis of the bobbins to the zone outside of the bobbins and for three minutes in the opposite direction. Subsequently, the bath liquid was drained off and the bobbins were removed from the apparatus, placed into a centrifugal dryer where a part of the adhering bath liquid was removed.

The removal of the bath liquid was effected in such a way that the bobbins retained 40%, by weight, (relative to their weight in the dry untreated state) of the bath liquid which theoretically corresponds to 4.4%, by weight, of the $\alpha,\omega$-bis(trimethylsiloxy)dimethyl polysiloxane oil. Finally, the bobbins were dried by allowing them to stay in a ventilated oven at a temperature of about 80° C. for 24 hours.

Quantitative determinations of the organosilicon polymer content, which were effected on several samples of the thread of the bobbins show that this thread retained, in a homogenous distribution, an amount of about 4.3% of the $\alpha,\omega$-bis(trimethylsiloxy)dimethyl polysiloxane oil. This percentage of the oil is calculated relative to the weight of the thread in the dry non-treated state.

For comparative purposes, the ethylene polyterephthalate thread was treated in the same above described apparatus but by using the method of exhaustive extraction which is used for dyeing. This method consists in circulating the dyeing bath liquid until the most complete possible amount of dye stuffs is fixed on the threads.

In this test, the treatment was carried out according to the process below:

After the bobbins had been placed on the corresponding perforated axes and demineralized water (an amount of 10 parts of water per 1 part of dry, non-treated thread on the bobbins) had been introduced into the chamber of the apparatus, the water was heated to a temperature of 60° C., then such an amount of the emulsion "Q" was added which was sufficient for forming a bath liquid containing 10 g per liter of this emulsion (theoretically, the total amount of dimethylpolysiloxane oil which was contained in 1,000 g of the bath liquid, namely, 5.5 g, had to be fixed to 100 g of the thread).

The pH value was adjusted to 6.2, the liquid was circulated alternatingly in the direction from the internal zone within the bobbins to the zone outside the bobbins and in the opposite direction and the temperature of the bath was raised to 80° C. within a period of 10 minutes. Subsequently, the temperature of 80° C., as well as circulating the bath liquid, were maintained for 20 minutes.

Excess bath liquid was then removed from the bobbins until these retained less than 50% of the bath liquid relative to their weight, and the bobbins were dried by allowing them to stay in a ventilated oven at a temperature of about 80° C. for 24 hours. Determinations of the organosilicon polymer content in the bath liquid showed that the extracted amount was in the range of about 85%; thus, only 4.7% of the $\alpha,\omega$-bis(trimethylsiloxy) dimethyl polysiloxane oil had been fixed on the thread instead of the theoretical amount of 5.5%.

With both threads, the one which was treated by the impregnation process according to the present invention and the one which was treated according to the exhaustive extraction method, six layers of a cotton fabric (weighing 170 g/$m^2$ of the slightly twisted web type), which were placed on top of each other, were sewed together by means of a high speed sewing machine. The machine which was used effected 6,000 stitches per minute, it operated for 1 minute then stopped for 10 seconds and re-started again following the same rhythm. The number of ruptures per 100 meters of used thread were determined.

In the Table below, the characteristic features of the two processes used in this example, as well as the number of ruptures per 100 meters of treated thread in the above sewing test, are summarized (a prior sewing test with a non-treated thread showed that sewing was impossible since the non-treated thread broke at least once each meter).

TABLE

| Process used | Period of treatment (minutes) | Temperature of treatment | Number of ruptures per 100 m of thread used on the sewing machine |
|---|---|---|---|
| Impregnation process according to the invention | 6 | 22° C. | 7 |
| Exhaustive extraction | 30 | 80° C. | 9 |

It is noted that the treatment according to the present invention not only necessitates little time and is effected at ambient temperature, but also results in an improved lubrication of the thread.

EXAMPLE 2

The same apparatus as is described in Example 1 was used, and the same bobbins of thread as were used in Example 1 were impregnated with an aqueous bath liquid which was obtained by mixing 80 parts of demineralized water with 20 parts of an aqueous liquid containing a block copolymer of polydimethylsiloxane polyether blocks diluted with water. This liquid consisted of 60% of water and 40% of the block copolymer having a viscosity of 2,000 cp at 25° C., and corresponding to the formula $$(CH_3)_3Si(OSi(CH_3)_2)_{75}(OSi(CH_3)(CH_2)_3(OCH_2CH_2)_{22}(O-\underset{\underset{CH_3}{|}}{CH}-CH_2)_{23.5} \longrightarrow$$

$$OCOCH_3)_7OSi(CH_3)_3.$$

Thus, the aqueous bath liquid comprised 8% of the block copolymer. The treatment of the thread was effected in the same manner as is described in Example 1, by circulating the bath liquid for 6 minutes. Subsequently, the excess bath liquid was removed from the bobbins in such a way that the bobbins retained an amount of 50%, by weight (relative to the weight in the dry non-treated state), of the aqueous bath liquid which theoretically corresponds to 4% of the block copolymer. The bobbins were then dried by blowing hot air which was heated to a temperature of 110° C. thereon.

With the thus treated thread, six layers of a cotton fabric (weighing 170 g/m$^2$ of the slightly twisted web type), which were placed on top of each other, were sewed together by means of the sewing machine described in Example 1. The number of ruptures per 100 meter of used thread was in the range of about 8.

What is claimed is:

1. A process for lubricating textile threads by treatment in an aqueous bath containing a lubricating agent comprising the steps of:
   (a) impregnating moist bobbins of the textile thread which have been moistened with an essentially aqueous liquid with an aqueous bath liquid containing dispersed therein an amount of from about 6 to about 20%, by weight, of at least one organosilicon polymer lubricating agent at a temperature of between about 15° and about 30° C.
   (b) removing the impregnated bobbins of thread from the bath liquid;
   (c) removing from the impregnated bobbins such an amount of adhering bath liquid that the resulting moist bobbins of thread retain only an amount of from about 25 to about 70%, by weight, of the bath liquid relative to the weight of the dry thread; and,
   (d) drying the moist bobbins of thread sufficiently to substantially remove their adsorbed water content.

2. The process as defined in claim 1, wherein the bobbins of thread are moistened to a water content of at least 120%, by weight, relative to the weight of the dry threads.

3. The process as defined in claim 1, wherein the impregnating step is effected by circulating the bath liquid through the bobbins of thread in a bath chamber.

4. The process as defined in claim 1, wherein the impregnating step is effected with moist bobbins of thread directly after a rinsing step of a dyeing operation.

5. The process as defined in claim 4, wherein the impregnating step is effected in a dyeing apparatus.

6. The process as defined in claim 1, wherein the removal of the adhering bath liquid in step (c) is effected at a temperature of between about 15° and about 30° C.

7. The process as defined in claim 1, wherein the removal of the adhering bath liquid in step (c) is effected centrifugally.

8. The process as defined in claim 1, wherein the amount of organosilicon polymer lubricating agent in the aqueous bath liquid is from about 7 to about 18%, by weight.

9. The process as defined in claim 1, wherein the amount of the bath liquid which is retained by the bobbins of thread after the removal step (c) is from about 28 to about 67%, by weight, relative to the weight of the dry thread.

10. The process as defined in claim 1, wherein the thread comprises a major portion of at least one synthetic fiber material.

11. The process as defined in claim 10, wherein the synthetic fiber material is selected from the group consisting of polyamides, polyesters, polyethylene, polyacrylnitrile, and polyurethane.

12. The process as defined in claim 1, wherein the aqueous bath liquid further comprises an emulsifying agent.

13. The process as defined in claim 12, wherein the emulsifying agent is present in an amount of from about 2 to about 15%, by weight, relative to the amount of the lubricating agent.

14. The process as defined in claim 1, wherein the organosilicon polymer is a polymer comprising recurring diorganosiloxyl units of the formula $$-\overset{\overset{R}{|}}{\underset{\underset{R}{|}}{Si}}-O$$

wherein the substituents R are the same or different and each represents a hydrocarbon group containing 1 to 18 carbon atoms, which is unsubstituted or substituted by halogen, cyano or amino.

15. The process as defined in claim 1, wherein the viscosity of the organosilicon polymer, at 25° C., is from about 50 cp to about 10 million cp.

16. The process as defined in claim 14, wherein the organosilicon polymer is a polydiorganosiloxane, wherein each of the ends of a chain of the recurring diorganosiloxyl units is terminated by a group selected from the group consisting of hydroxy, alkoxy containing 1 to 4 carbon atoms, and a triorganosiloxyl group, $R_3SiO$, wherein R is as defined above.

17. The process as defined in claim 14, wherein the organosilicon polymer is a block copolymer comprising polydiorganosiloxane blocks which are formed by the recurring diorganosiloxyl units and polyether blocks.

18. The process as defined in claim 17, wherein the polyether blocks are comprised of lower oxyalkylene units.

19. The process as defined in claim 18, wherein the polydiorganosiloxane blocks are comprised of dimethylsiloxyl units.

20. The process as defined in claim 19, wherein the block copolymers are selected from the group consisting of compounds of the formulae $F_1$ and $F_2$ $$R''Si\left[(OSi(CH_3)_2)_a\,(\underset{\underset{CH_3}{|}}{OCHCH_2})_b\,(OCH_2CH_2)_cOR'''\right]_3 \qquad (F_1)$$

$$R'(CH_3)_2Si(OSi(CH_3)_2)_a(OSi(CH_3)G(\underset{\underset{CH_3}{|}}{OCH}-CH_2)_b(OCH_2CH_2)_cOR''')_dOSi(CH_3)_2R' \qquad (F_2)$$

wherein R' represents methyl, ethyl, vinyl or phenyl, R'' represents methyl or ethyl, R''' represents hydrogen, methyl, ethyl, propyl, butyl or acetyl, G represents alkylene containing 1 to 4 carbon atoms, a represents a number of from about 5 to about 180, b represents a number of from about 3 to about 50, c represents a number of from zero to about 40, whereby in the case that c does not represent zero, the sum of b+c is a number of from about 8 to about 70 and the ratio b/c is at least 0.2, and d represents a number of from 1 to about 50.

21. The process as defined in claim 1 wherein the amount of bath liquid retained in the bobbin is equivalent to an amount of 1.5% to 14% by weight of organosilicon polymer relative to the weight of the dry thread.

* * * * *